US008235678B2

(12) United States Patent
Stones

(10) Patent No.: US 8,235,678 B2
(45) Date of Patent: Aug. 7, 2012

(54) MULTI-STAGE VACUUM PUMPING ARRANGEMENT

(75) Inventor: Ian David Stones, Burgess Hill (GB)

(73) Assignee: Edwards Limited, Crawley, West Sussex (GB)

( * ) Notice: Subject to any disclaimer, the term of this patent is extended or adjusted under 35 U.S.C. 154(b) by 1024 days.

(21) Appl. No.: 11/666,721

(22) PCT Filed: Oct. 18, 2005

(86) PCT No.: PCT/GB2005/004031

§ 371 (c)(1),
(2), (4) Date: Oct. 3, 2007

(87) PCT Pub. No.: WO2006/048602

PCT Pub. Date: May 11, 2006

(65) Prior Publication Data

US 2008/0193303 A1 Aug. 14, 2008

(30) Foreign Application Priority Data

Nov. 1, 2004 (GB) ..... 0424198.0

(51) Int. Cl.
*F04B 23/14* (2006.01)
*F04B 23/08* (2006.01)
*F04B 35/04* (2006.01)

(52) U.S. Cl. ..... 417/203; 417/205; 417/266; 417/423.4

(58) Field of Classification Search ..... 417/201, 417/203, 205, 250, 266, 423.4; 73/40, 40.7
See application file for complete search history.

(56) References Cited

U.S. PATENT DOCUMENTS 4,472,962 A * 9/1984 Mennenga ..... 73/40.7
5,341,671 A * 8/1994 Baret et al. ..... 73/40.7
5,561,240 A * 10/1996 Ochiai et al. ..... 73/40.7
5,733,104 A * 3/1998 Conrad et al. ..... 417/44.1
6,135,709 A * 10/2000 Stones ..... 415/90

(Continued)

FOREIGN PATENT DOCUMENTS

EP 0 343 914 B1 11/1989

(Continued)

OTHER PUBLICATIONS

United Kingdom Search Report of Application No. GB 0424198.0; Claims searched: 1-40; Date of search: Dec. 20, 2004.

(Continued)

*Primary Examiner* — Charles Freay

(57) ABSTRACT

A differentially pumped vacuum system includes first, second and third chambers, and a pumping arrangement for evacuating the chambers. The pumping arrangement includes a compound pump having a first inlet connected to an outlet from the first chamber, a second inlet connected to an outlet from the second chamber, a first pumping section and a second pumping section downstream from the first pumping section, the sections being arranged such that fluid entering the compound pump from the first inlet passes through the first and second pumping sections and fluid entering the compound pump from the second inlet passes through, of said sections, only the second section. The pumping arrangement further includes a booster pump having an inlet connected to an outlet from the third chamber, and a backing pump having an inlet connected to the exhaust from the booster pump. Fluid exhaust from the compound pump can be conveyed to either a second booster pump inlet or the backing pump inlet as required.

24 Claims, 7 Drawing Sheets

U.S. PATENT DOCUMENTS

| | | | | |
|---|---|---|---|---|
| 6,282,946 | B1 * | 9/2001 | Gevaud et al. | 73/40.7 |
| 6,658,920 | B2 * | 12/2003 | Abbel | 73/40 |
| 2004/0076529 | A1 | 4/2004 | Gnauck et al. | |

FOREIGN PATENT DOCUMENTS

| | | | |
|---|---|---|---|
| EP | 0 603 694 | A1 | 6/1994 |
| EP | 1 302 667 | A1 | 4/2003 |
| GB | 236066 | | 7/1925 |

OTHER PUBLICATIONS

PCT Notification of Transmittal of the International Search Report and the Written Opinion of the International Searching Authority, or the Declaration of International Application No. PCT/GB2005/004031; Date of mailing: Jun. 26, 2006.

PCT International Search Report of International Application No. PCT/GB2005/004031; Date of mailing of the International Search Report: Jun. 26, 2006.

PCT Written Opinion of the International Searching Authority of International Application No. PCT/GB2005/004031; Date of mailing: Jun. 26, 2006.

* cited by examiner

MULTI-STAGE VACUUM PUMPING ARRANGEMENT

FIELD OF THE INVENTION

This invention relates to a pumping arrangement and in particular to a pumping arrangement for differentially evacuating a vacuum system.

BACKGROUND OF THE INVENTION

In a differentially pumped mass spectrometer system a sample and carrier gas are introduced to a mass analyser for analysis. One such example is given in FIG. 1. With reference to FIG. 1, in such a system there exists a high vacuum chamber 10 immediately following first, (depending on the type of system) second, and third evacuated interface chambers 11, 12, 14. The first interface chamber is the highest-pressure chamber in the evacuated spectrometer system and may contain an orifice or capillary through which ions are drawn from the ion source into the first interface chamber 11. The second, optional interface chamber 12 may include ion optics for guiding ions from the first interface chamber 11 into the third interface chamber 14, and the third chamber 14 may include additional ion optics for guiding ions from the second interface chamber into the high vacuum chamber 10. In this example, in use, the first interface chamber is at a pressure of around 1-10 mbar, the second interface chamber (where used) is at a pressure of around $10^{-1}$-1 mbar, the third interface chamber is at a pressure of around $10^{-2}$-$10^{-3}$ mbar, and the high vacuum chamber is at a pressure of around $10^{-5}$-$10^{-6}$ mbar.

The high vacuum chamber 10, second interface chamber 12 and third interface chamber 14 can be evacuated by means of a compound vacuum pump 16. In this example, the vacuum pump has two pumping sections in the form of two sets 18, 20 of turbo-molecular stages, and a third pumping section in the form of a Holweck drag mechanism 22; an alternative form of drag mechanism, such as a Siegbahn or Gaede mechanism, could be used instead. Each set 18, 20 of turbo-molecular stages comprises a number (three shown in FIG. 1, although any suitable number could be provided) of rotor 19*a*, 21*a* and stator 19*b*, 21*b* blade pairs of known angled construction. The Holweck mechanism 22 includes a number (two shown in FIG. 1 although any suitable number could be provided) of rotating cylinders 23*a* and corresponding annular stators 23*b* and helical channels in a manner known per se.

In this example, a first pump inlet 24 is connected to the high vacuum chamber 10, and fluid pumped through the inlet 24 passes through both sets 18, 20 of turbo-molecular stages in sequence and the Holweck mechanism 22 and exits the pump via outlet 30. A second pump inlet 26 is connected to the third interface chamber 14, and fluid pumped through the inlet 26 passes through set 20 of turbo-molecular stages and the Holweck mechanism 22 and exits the pump via outlet 30. In this example, the pump 16 also includes a third inlet 27 which can be selectively opened and closed and can, for example, make the use of an internal baffle to guide fluid into the pump 16 from the second, optional interface chamber 12. With the third inlet open, fluid pumped through the third inlet 27 passes through the Holweck mechanism only and exits the pump via outlet 30.

In this example, in order to minimise the number of pumps required to evacuate the spectrometer, the first interface chamber 11 is connected via a foreline 31 to a backing pump 32, which also pumps fluid from the outlet 30 of the compound vacuum pump 16. The backing pump typically pumps a larger mass flow directly from the first chamber 11 than that from the outlet 30 of the compound vacuum pump 16. As fluid entering each pump inlet passes through a respective different number of stages before exiting from the pump, the pump 16 is able to provide the required vacuum levels in the chambers 10, 12, 14, with the backing pump 32 providing the required vacuum level in the chamber 11.

The performance and power consumption of the compound pump 16 is dependent largely upon its backing pressure, and is therefore dependent upon the foreline pressure (and the pressure in the first interface chamber 11) offered by the backing pump 32. This in itself is dependent mainly upon two factors, namely the total mass flow rate entering the foreline 31 from the spectrometer and the pumping capacity of the backing pump 32. Many compound pumps having a combination of turbo-molecular and molecular drag stages are only ideally suited to relatively low backing pressures, and so if the pressure in the foreline 31 (and hence in the first interface chamber 11) increases as a result of increased mass flow rate or a smaller backing pump size, the resulting deterioration in performance and increase in power consumption can be rapid. In an effort to increase mass spectrometer performance, manufacturers often increase the mass flow rate into the spectrometer, thus requiring increased size or number of backing pumps in parallel to accommodate for the increased mass flow rate. This increases both costs, size and power consumption of the overall pumping system required to differentially evacuate the mass spectrometer.

In at least its preferred embodiments, the present invention seeks to provide a relatively compact, low cost, low power pumping arrangement that can enable substantially increased mass flow rates whilst retaining a low system pressures.

SUMMARY OF THE INVENTION

In a first aspect, the present invention provides a pumping arrangement for differentially pumping a plurality of chambers, the pumping arrangement comprising a compound pump comprising a first inlet for receiving fluid from a first chamber, a second inlet for receiving fluid from a second chamber, a first pumping section and a second pumping section downstream from the first pumping section, the sections being arranged such that fluid entering the compound pump from the first inlet passes through the first and second pumping sections and fluid entering the compound pump from the second inlet passes through, of said sections, only the second section; a booster pump having an inlet for receiving fluid from a third chamber; a backing pump having an inlet for receiving fluid exhaust from the booster pump; and means for conveying fluid exhaust from the compound pump to one of booster pump and the backing pump.

The present invention extends to a differentially pumped vacuum system comprising first, second and third chambers, and a pumping arrangement as aforementioned for evacuating the chambers. Therefore, in a second aspect the present invention provides a differentially pumped vacuum system comprising first, second and third chambers, and a pumping arrangement for evacuating the chambers, the pumping arrangement comprising a compound pump comprising a first inlet connected to an outlet from the first chamber, a second inlet connected to an outlet from the second chamber, a first pumping section and a second pumping section downstream from the first pumping section, the sections being arranged such that fluid entering the compound pump from the first inlet passes through the first and second pumping sections and fluid entering the compound pump from the second inlet passes through, of said sections, only the second section; a booster pump having an inlet connected to an outlet from the third chamber; a backing pump having an inlet connected to the exhaust from the booster pump; and means for conveying fluid exhaust from the compound pump directly to one of the booster pump and the backing pump.

The compound pump may be conveniently mounted on at least one of the first and second chambers, and/or the booster pump may be conveniently mounted on the third chamber.

In the preferred embodiments, the chambers form part of a mass spectrometer system.

In a third aspect the present invention provides a method of differentially evacuating a plurality of pressure chambers, the method comprising the steps of providing a pumping arrangement comprising a compound pump comprising a first inlet, a second inlet, an outlet, a first pumping section and a second pumping section downstream from the first pumping section, the sections being arranged such that fluid entering the compound pump from the first inlet passes through the first and second pumping sections and fluid entering the compound pump from the second inlet passes through, of said sections, only the second section; a booster pump having at least one booster pump inlet and a booster pump outlet, and a backing pump having a backing pump inlet; connecting the pumping arrangement to the pressure chambers such that the first compound pump inlet is connected to an outlet from the first chamber, the second compound pump inlet is connected to an outlet from the second chamber, and a booster pump inlet is connected to an outlet of the third chamber; connecting the backing pump inlet to the booster pump outlet; and connecting the outlet from the compound pump to one of the backing pump and the booster pump. Features described above relating to pumping arrangement or system aspects of the invention are equally applicable to method aspects, and vice versa.

BRIEF DESCRIPTION OF THE DRAWINGS

Preferred features of the present invention will now be described, by way of example only, with reference to the accompanying drawings, in which.

DETAILED DESCRIPTION OF THE INVENTION

Figure 1:
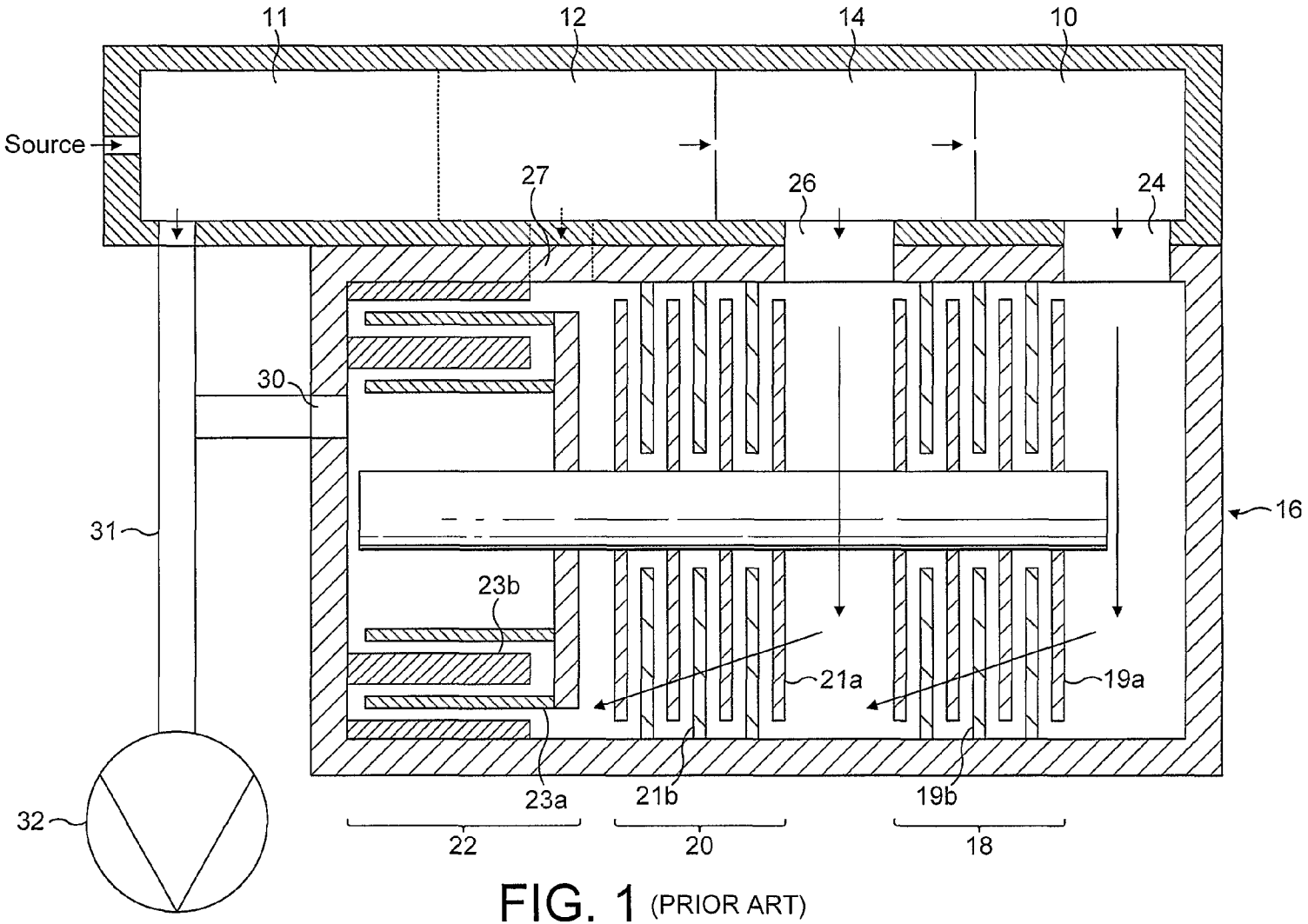
FIG. 1 (PRIOR ART)
FIG. 1 is a simplified cross-section through a known pumping arrangement suitable for evacuating a differentially pumped, mass spectrometer system.

In a first aspect, the present invention provides a pumping arrangement for differentially pumping a plurality of chambers, the pumping arrangement comprising a compound pump comprising a first inlet for receiving fluid from a first chamber, a second inlet for receiving fluid from a second chamber, a first pumping section and a second pumping section downstream from the first pumping section, the sections being arranged such that fluid entering the compound pump from the first inlet passes through the first and second pumping sections and fluid entering the compound pump from the second inlet passes through, of said sections, only the second section; a booster pump having an inlet for receiving fluid from a third chamber; a backing pump having an inlet for receiving fluid exhaust from the booster pump; and means for conveying fluid exhaust from the compound pump to one of booster pump and the backing pump.

As used herein, the term "booster pump" means a pump which, in use, exhausts fluid at a pressure below atmospheric pressure, and the term "backing pump" means a pump which, in use, exhausts fluid at or around atmospheric pressure.

For a given pumping mechanism type, the various design parameters typically offer a compromise of capacity against compression. As such, if the compression requirements are reduced as is the case in the booster pump (not pumping to atmospheric pressure) the capacity can be increased. Thus, in principle, a booster pump can offer a much higher level of pumping speed and reduced power than an equivalently sized atmospheric exhausting machine of the same mechanism type.

Unlike turbomolecular pumps, booster pumps are not specifically designed to operate in a molecular flow regime, but are rather designed to operate in a low viscous to high transitional pressure regime. By providing a booster pump and a backing pump in series, a higher level of performance can be provided at the third, or highest, pressure chamber than in the prior art arrangement shown in FIG. 1, thereby allowing the mass flow rate into the third chamber to be increased without increasing the pressure at the third chamber. With the exhaust from the compound pump being directed to either the booster pump or the backing pump according to the performance requirement of the first and second chambers, the present invention can thus provide a relatively compact and low cost pumping arrangement for differentially pumping the first to third chambers (in comparison to a solution employing larger or multiple backing pumps all exhausting to atmospheric pressure).

Each pumping stage of the compound pump preferably comprises a dry pumping stage, that is, a pumping stage that requires no liquid or lubricant for its operation. The compound pump preferably comprises at least three pumping sections, each section comprising at least one pumping stage. In the preferred embodiments, the compound pump comprises a first pumping section, a second pumping section downstream from the first pumping section, and a third pumping section downstream from the second pumping section, the sections being positioned relative to the first and second inlets such that fluid entering the pump through the first inlet passes through the first, second and third pumping sections, and fluid entering the pump through the second inlet passes through, of said sections, only the second and third pumping sections.

Preferably at least one of the first and second pumping sections comprises at least one turbo-molecular stage. Both of the first and second pumping sections may comprise at least one turbo-molecular stage. The stage of the first pumping section may be of a different size to the stage of the second pumping section. For example, the stage of the second pumping section may be larger than the stage of the first pumping section to offer selective pumping performance.

The third pumping section preferably comprises at least one molecular drag stage. In the preferred embodiments, the third section comprises a multi-stage Holweck mechanism with a plurality of channels arranged as a plurality of helixes. In one embodiment, to improve pump performance, the third pumping section comprises at least one Gaede pumping stage and/or at least one aerodynamic pumping stage for receiving fluid entering the pump from each of the first, second and third chambers, with the Holweck mechanism being positioned upstream from said at least one Gaede pumping stage and/or at least one aerodynamic pumping stage. The aerodynamic pumping stage may be a regenerative stage; other types of aerodynamic mechanism may be side flow, side channel, and peripheral flow mechanisms. In one preferred embodiment, a rotor element of the molecular drag pumping stage(s) surrounds rotor elements of the regenerative pumping stage(s). By arranging the pumping section in this manner, improved pump performance can be provided with no, or little, increase in pump size.

The compound pump preferably comprises a drive shaft having mounted thereon at least one rotor element for each of the pumping stages. The rotor elements of at least two of the pumping sections may be located on, preferably integral with, a common impeller mounted on the drive shaft. For example, rotor elements for the first and second pumping sections may be integral with the impeller. Where the third pumping section comprises a molecular drag stage, an impeller for the molecular drag stage may be located on a rotor integral with the impeller. For example, the rotor may comprise a disc substantially orthogonal to, preferably integral with, the impeller. Where the third pumping section comprises a regenerative pumping stage, rotor elements for the regenerative pumping stage are preferably integral with the impeller.

Various arrangements of inlets to the compound pump and booster pump, and their respective connections to outlets of chambers to be evacuated using the pumping arrangement, may be provided. Some examples of these are detailed below.

For example, the compound pump may comprise an optional third inlet for receiving fluid from a fourth chamber. This third inlet is preferably located such that fluid entering the compound pump through the third inlet passes through, of said sections, only the third pumping section, so that the pumping arrangement can create a different vacuum level at the fourth chamber than at any of the first to third chambers.

Alternatively, the compound pump may comprise a third inlet for receiving fluid from the third chamber in parallel with the booster pump. Providing such parallel pumping of a chamber can provide a greater level of performance on the parallel pumped chamber than using a single pump inlet of the same capacity. The third inlet may be arranged such that fluid entering the compound pump through the third inlet passes through, of said sections, only the third pumping section. In one preferred embodiment, the third pumping section is positioned relative to the second and third pump inlets such that fluid passing therethrough from the third pump inlet follows a different path from fluid passing therethrough from the second pump inlet. For example, fluid entering the compound pump through the second inlet may pass through a greater number of pumping stages of the third pumping section that fluid entering the compound pump through the third inlet.

In addition to this third inlet, the compound pump may include an optional fourth inlet for receiving fluid from a fourth chamber. This fourth inlet may be located such that fluid entering the compound pump through the fourth inlet passes through, of said sections, only the third pumping section. The booster pump may comprise a second inlet for receiving fluid from the fourth chamber in parallel with the fourth inlet of the compound pump.

The booster pump may comprise any convenient pumping mechanism. A frequency-independent booster pump (that is to say a pump which operates at a frequency which is not dependant upon mains supply frequency) or inverter-driven pump, for example a scroll pump, may provide the booster pump. Alternatively, as in the preferred embodiments described below, the booster pump may be a high speed, single axis pumping machine having one or more pumping stages similar to those of the compound pump. In other words, the booster pump preferably comprises a plurality of pumping stages, with the pumping mechanisms of these stages being selected according to the backing pump inlet pressure, the mass flow rate and the pressure requirements of the third chamber. Each pumping stage of the booster pump preferably comprises a dry pumping stage. In the preferred embodiments, the booster pump comprises a molecular drag mechanism. In one embodiment, the booster pump comprises at least one Gaede pumping stage and/or at least one aerodynamic pumping stage, for example a regenerative pumping mechanism, located downstream from the molecular drag pumping mechanism.

A rotor element of the molecular drag pumping mechanism preferably comprises a cylinder mounted for rotary movement with the rotor elements of the regenerative pumping mechanism. This cylinder preferably forms part of a multi-stage Holweck pumping mechanism. Whilst in one preferred embodiment the booster pump comprises a two stage Holweck pumping mechanism, additional stages may be provided by increasing the number of cylinders and corresponding stator elements accordingly. The additional cylinder(s) can be mounted on the same impeller disc at a different diameter in a concentric manner such that the axial positions of the cylinders are approximately the same.

The rotor element of the molecular drag pumping mechanism and the rotor elements of the regenerative pumping mechanism may be conveniently located on a common rotor of the booster pump. This rotor is preferably integral with an impeller mounted on the drive shaft of the pump, and may be provided by a disc substantially orthogonal to the drive shaft. The rotor elements of the regenerative pumping mechanism may comprise a series of blades positioned in an annular array on one side of the rotor. These blades are preferably integral with the rotor. With this arrangement of blades, the rotor element of the molecular drag pumping mechanism can be conveniently mounted on the same side of the rotor.

The regenerative pumping mechanism may comprise more than one stage, and so include at least two series of blades positioned in concentric annular arrays on said one said of the rotor such that the axial positions of the blades are approximately the same.

To assist in minimising the size of the pump, a common stator may be provided for the regenerative pumping mechanism and at least part of the molecular drag pumping mechanism.

In some embodiments, the booster pump comprises a first inlet for receiving fluid from the third chamber and a second inlet for receiving fluid exhaust from the compound pump. These two inlets may be combined into a single port in the booster pump depending upon the configuration of booster pump and compound pump ports selected. In these embodiments, the pumping stages of the booster pump may be arranged relative to the inlets of the booster pump such that fluid entering the booster pump through one of the booster pump inlets passes through the same number of pumping stages than fluid entering the booster pump through the other one of the booster pump inlets. In this case, the booster pump may pump both gas streams through a single port. In other embodiments, the booster pump comprises a first inlet for receiving fluid from the third chamber and a second inlet for receiving fluid from a fourth chamber. In these embodiments, the pumping stages of the booster pump may be arranged relative to the inlets of the booster pump such that fluid entering the booster pump through one of the booster pump inlets passes through a different number of pumping stages than fluid entering the booster pump through the other one of the booster pump inlets.

To provide a compact pumping arrangement, the pumping stages of the compound pump are preferably, although not essentially, co-axial with the pumping stages of the booster pump, and the booster pump may be conveniently mounted on the compound pump. The two pumps may also use a common power supply.

Where the fluid conveying means is configured to convey fluid from the pumping sections of the compound pump to the booster pump, the outlet of the compound pump may be simply connected to an inlet of the booster pump, with the fluid conveying means being provided by the exhaust conduit of the compound pump alone without the need for any additional conduits or pipework to convey fluid from the compound pump to the booster pump. Alternatively, where the fluid conveying means is configured to convey fluid from the pumping sections of the compound pump to the backing pump, the fluid conveying means may be provided by an arrangement of one or more conduits connecting both the outlet of the compound pump and the outlet of the booster pump to the inlet of the backing pump.

The present invention extends to a differentially pumped vacuum system comprising first, second and third chambers, and a pumping arrangement as aforementioned for evacuating the chambers. Therefore, in a second aspect the present invention provides a differentially pumped vacuum system comprising first, second and third chambers, and a pumping arrangement for evacuating the chambers, the pumping arrangement comprising a compound pump comprising a first inlet connected to an outlet from the first chamber, a second inlet connected to an outlet from the second chamber, a first pumping section and a second pumping section downstream from the first pumping section, the sections being arranged such that fluid entering the compound pump from the first inlet passes through the first and second pumping sections and fluid entering the compound pump from the second inlet passes through, of said sections, only the second section; a booster pump having an inlet connected to an outlet from the third chamber; a backing pump having an inlet connected to the exhaust from the booster pump; and means for conveying fluid exhaust from the compound pump directly to one of the booster pump and the backing pump.

The compound pump may be conveniently mounted on at least one of the first and second chambers, and/or the booster pump may be conveniently mounted on the third chamber.

In the preferred embodiments, the chambers form part of a mass spectrometer system.

In a third aspect the present invention provides a method of differentially evacuating a plurality of pressure chambers, the method comprising the steps of providing a pumping arrangement comprising a compound pump comprising a first inlet, a second inlet, an outlet, a first pumping section and a second pumping section downstream from the first pumping section, the sections being arranged such that fluid entering the compound pump from the first inlet passes through the first and second pumping sections and fluid entering the compound pump from the second inlet passes through, of said sections, only the second section; a booster pump having at least one booster pump inlet and a booster pump outlet, and a backing pump having a backing pump inlet; connecting the pumping arrangement to the pressure chambers such that the first compound pump inlet is connected to an outlet from the first chamber, the second compound pump inlet is connected to an outlet from the second chamber, and a booster pump inlet is connected to an outlet of the third chamber; connecting the backing pump inlet to the booster pump outlet; and connecting the outlet from the compound pump to one of the backing pump and the booster pump. Features described above relating to pumping arrangement or system aspects of the invention are equally applicable to method aspects, and vice versa.

Figure 2:
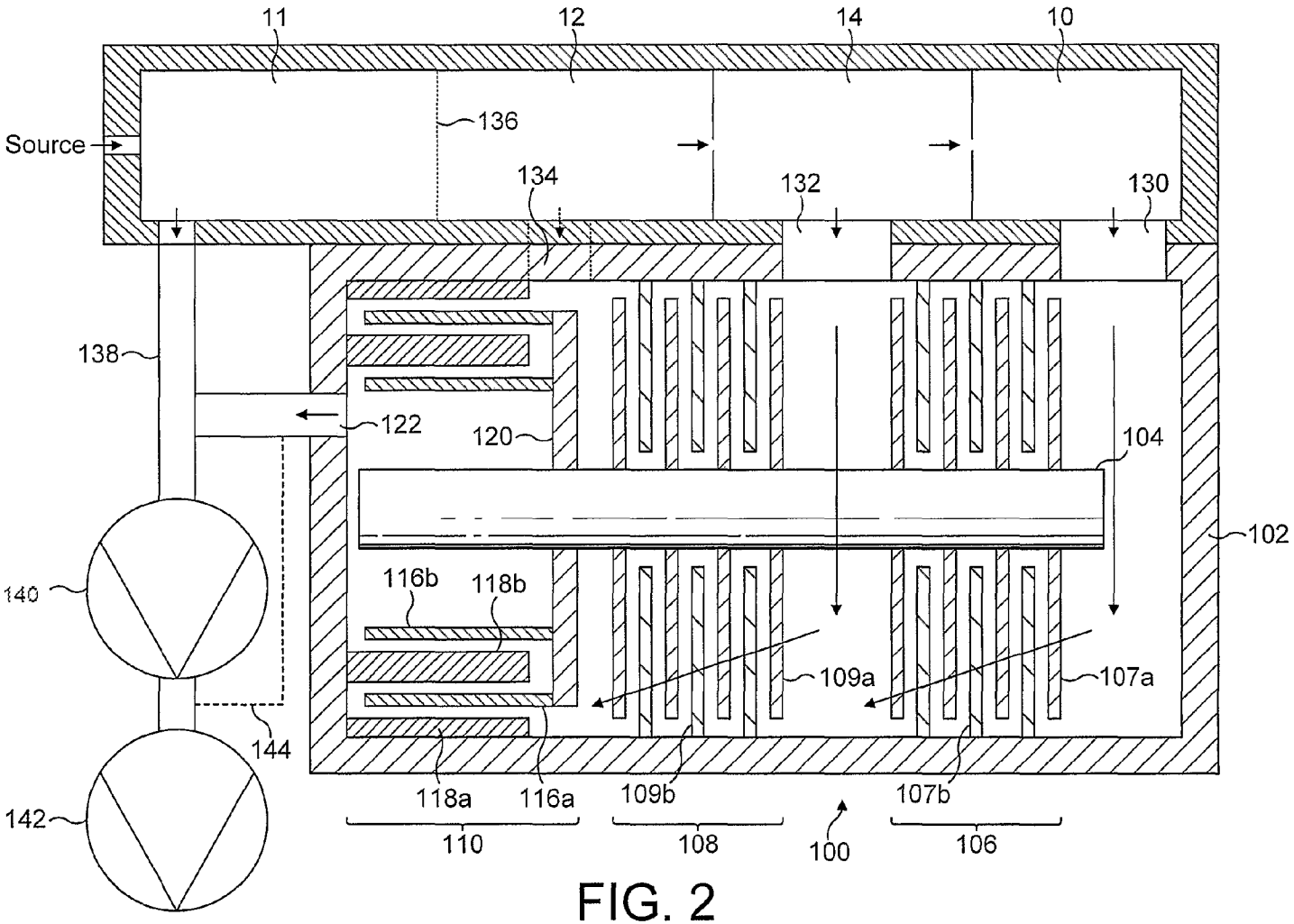
FIG. 2 is a simplified cross-section through a first embodiment of a pumping arrangement suitable for evacuating the differentially pumped mass spectrometer system of FIG. 1.

FIG. 2 illustrates a first embodiment of a pumping arrangement suitable for evacuating the mass spectrometer system of FIG. 1. The pumping arrangement comprises a compound pump 100 having a multi-component body 102 within which is mounted a drive shaft 104. Rotation of the shaft is effected by a motor (not shown), for example, a brushless dc motor, positioned about the shaft 104. The shaft 104 is mounted on opposite bearings (not shown). For example, the drive shaft 104 may be supported by a hybrid permanent magnet bearing and oil lubricated bearing system.

The pump includes at least three pumping sections 106, 108,110. The first pumping section 106 comprises a set of turbo-molecular stages. In the embodiment shown in FIG. 2, the set of turbo-molecular stages 106 comprises four rotor blades and three stator blades of known angled construction. A rotor blade is indicated at 107*a* and a stator blade is indicated at 107*b*. In this example, the rotor blades 107*a* are mounted on the drive shaft 104.

The second pumping section 108 is similar to the first pumping section 106, and also comprises a set of turbo-molecular stages. In the embodiment shown in FIG. 2, the set of turbo-molecular stages 108 also comprises four rotor blades and three stator blades of known angled construction. A rotor blade is indicated at 109*a* and a stator blade is indicated at 109*b*. In this example, the rotor blades 109*a* are also mounted on the drive shaft 104.

Downstream of the first and second pumping sections is a third pumping section 110. In the embodiment shown in FIG. 2, the third pumping section comprises a molecular drag pumping mechanism in the form of a Holweck drag mechanism. In this embodiment, the Holweck mechanism comprises two co-axial rotating cylinders 116*a*, 116*b* and corresponding annular stators 118*a*, 118*b* having helical channels formed therein in a manner known per se. In this embodiment, the Holweck mechanism comprises three pumping stages, although any number of stages may be provided depending on pressure, flow rate and capacity requirements.

The rotating cylinders 116*a*, 116*b* are preferably formed from a carbon fibre material, and are mounted on a rotor element 120, preferably in the form of a disc 120, which is located on the drive shaft 104. In this example, the disc 120 is also mounted on the drive shaft 104.

Downstream of the third pumping section is an exhaust conduit 122, which passes through the body 102 of the compound pump and provides an outlet for fluid exhaust from the compound pump 100.

As illustrated in FIG. 2, the compound pump 100 has two inlets 130, 132; although only two inlets are used in this embodiment, the pump may have an additional, optional inlet indicated at 134, which can be selectively opened and closed and can, for example, make the use of internal baffles to guide different flow streams to particular portions of a mechanism. The inlet 130 is located upstream of all of the pumping sections. The inlet 132 is located interstage the first pumping section 106 and the second pumping section 108. The optional inlet 134 is located interstage the second pumping section 108 and the third pumping section 110, such that all of the stages of the molecular drag pumping mechanism 112 are in fluid communication with the optional inlet 134.

In use, each inlet is connected to an outlet from a respective chamber of the differentially pumped vacuum system, in this embodiment the same mass spectrometer system as illustrated in FIG. 1. Thus, inlet 130 is connected to an outlet from low pressure chamber 10, and inlet 132 is connected to an outlet from the middle pressure chamber 14. Where another chamber 12 is present between the high pressure chamber 11 and the middle pressure chamber 14, as indicated by the dotted line 136, the optional inlet 134 is opened and connected to an outlet from this chamber 12. Additional lower pressure chambers may be added to the system, and may be pumped by separate means.

The high pressure chamber 11 is connected via a foreline 138 to a series connection of a booster pump 140 and a backing pump 142. The exhaust conduit 122 of the compound pump 100 is also connected to one of the booster pump 140 and the backing pump 142. For example, in the embodiment shown in FIG. 2, the exhaust conduit 122 is connected to the foreline 138, so that fluid exhaust from the compound pump 100 passes through both the booster pump 140 and the backing pump 142. Alternatively, as indicated by the dashed line 144 in FIG. 2, the exhaust conduit 122 may be connected to the backing pump 142 by a suitable arrangement of one or more conduits and disconnected from the booster pump 140. Valves may be provided at suitable locations in the exhaust conduit 122 and this conduit arrangement to enable a user to select whether the fluid exhaust from the compound pump 100 is conveyed to either the booster pump 140 or the backing pump 142.

In use, fluid passing through inlet 130 from the low pressure chamber 10 passes through the first pumping section 106, the second pumping section 108 and the third pumping section 110, and exits the compound pump 100 via exhaust conduit 122. Fluid passing through inlet 132 from the middle pressure chamber 14 enters the compound pump 100, passes through the second pumping section 108 and the third pumping section 110, and exits the compound pump 100 via exhaust conduit 122. If opened, fluid passing through the optional inlet 134 from chamber 12 enters the compound pump 100, passes through the third pumping section 110 only and exits the compound pump 100 via exhaust conduit 122. In the embodiment shown in FIG. 2, all of the fluid exhaust from the compound pump 100 merges with the fluid from the high pressure chamber 11, and passes through the series connection of booster pump 140 and backing pump 142 before being exhaust from the pumping arrangement at or around atmospheric pressure.

In this example, in use, and similar to the system described with reference to FIG. 1, the high pressure chamber 11 is at a pressure around 1-10 mbar, the optional chamber 12 (where used) is at a pressure of around $10^{-1}$-1 mbar, the middle pressure chamber 14 is at a pressure of around $10^{-2}$-$10^{-3}$ mbar, and the low chamber 10 is at a pressure of around $10^{-5}$-$10^{-6}$ mbar. However, due the additional compression of both the gas exhaust from the compound pump 100 and the gas drawn from the high pressure chamber 11 by the booster pump 140, the booster pump 140 can serve to deliver a lower backing pressure to the compound pump 100 than in the prior art whilst accommodating for an increased mass flow rate into the high pressure chamber 11. This can significantly reduce the power consumption of the pumping arrangement and improve the overall pumping performance.

The booster pump 140 may include any suitable pumping mechanism for meeting the performance and power level requirements of the pumping arrangement. For example, a frequency-independent pump or inverter driven pump, such as a scroll pump, may provide the booster pump 140. However, in the following embodiments the booster pump 140 is illustrated as a high speed, single axis pumping machine having one or more pumping stages similar to those of the compound pump 100

Figure 3:
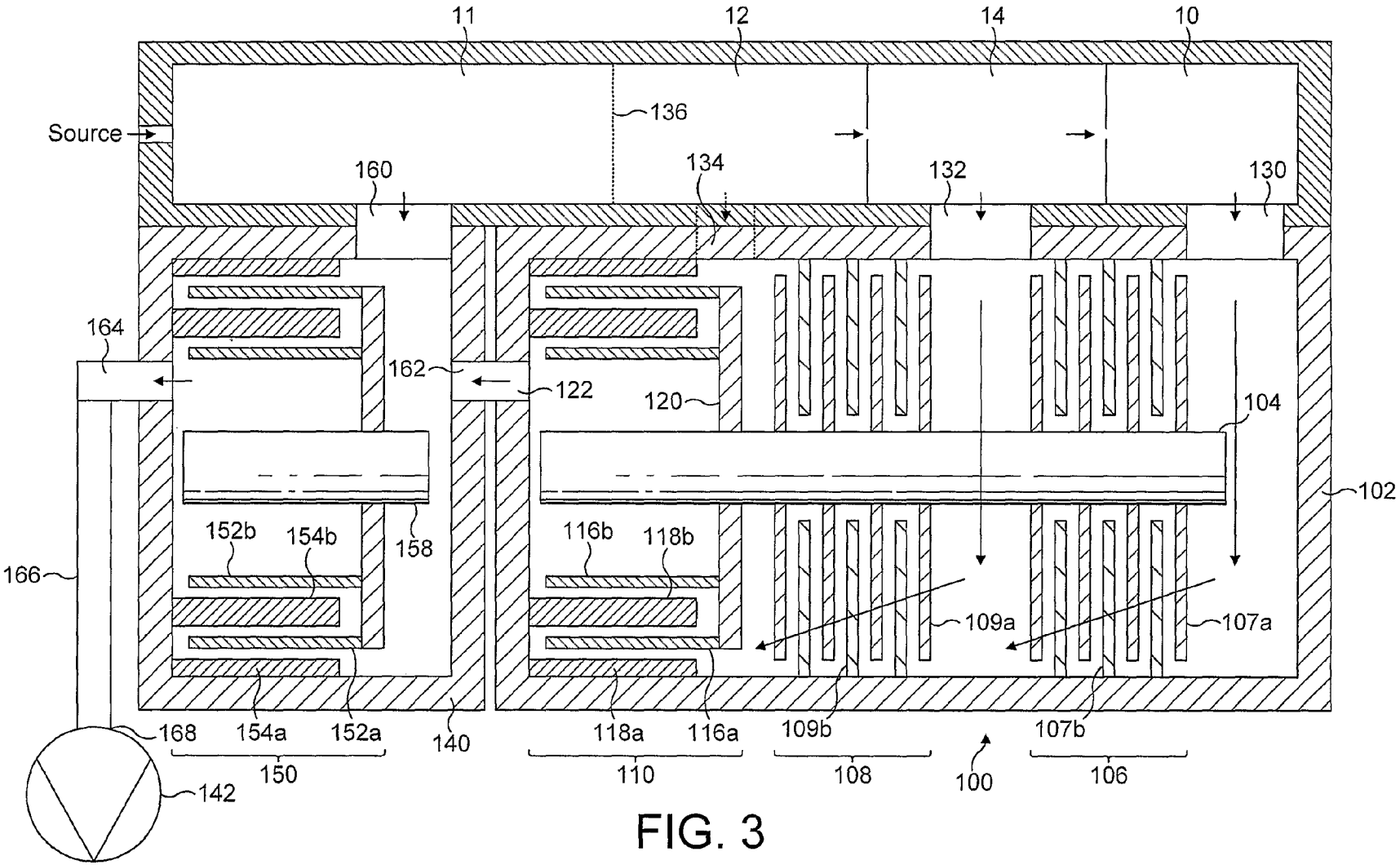
FIG. 3 is a simplified cross-section through a second embodiment of a pumping arrangement suitable for evacuating the differentially pumped mass spectrometer system of FIG. 1.

With reference first to the second embodiment of a pumping arrangement illustrated in FIG. 3, the booster pump 140 has a pumping section 150 comprising a molecular drag pumping mechanism in the form of a Holweck drag mechanism. In this embodiment, similar to the compound pump 100 the Holweck mechanism comprises two co-axial rotating cylinders 152*a*, 152*b* and corresponding annular stators 154*a*, 154*b* having helical channels formed therein in a manner known per se. In this embodiment, the Holweck mechanism comprises three pumping stages, although again any number of stages may be provided depending on pressure, flow rate and capacity requirements. The rotating cylinders 152*a*, 152*b* are preferably formed from a carbon fibre material, and are mounted on a rotor element 156, preferably in the form of a disc 156, which is located on the drive shaft 158. In this example, the disc 156 is also mounted on the drive shaft 158. Rotation of the drive shaft 158 is effected by a motor (not shown), for example, a brushless dc motor, positioned about the shaft 158. The shaft 158 is mounted on opposite bearings (not shown). For example, the drive shaft 158 may be supported by a hybrid permanent magnet bearing and oil lubricated bearing system. In view of the possible close proximity of the pumps 100, 140, the motors for rotating the drive shafts 104, 158 of the pumps 100, 140 may be driven by a common power supply.

In this embodiment, the booster pump 140 is mounted on the high pressure chamber 11 and the compound pump 100 is mounted on one, or both of the low pressure chamber 10 and middle pressure chamber 14 such that the drive shafts 104, 158 of the compound pump 100 and booster pump 140 are substantially co-axial. Alternatively, the booster pump 140 may be mounted on the compound pump 100, or vice versa. Equally, the booster pump could be mounted near or onto the backing pump depending upon space requirements. It is advantageous to keep the booster pump near the chamber to minimise conductance losses in the pipe connecting the booster pump to chamber 11.

The booster pump 140 has a first inlet 160 connected to an outlet from the high pressure chamber 11, and an inlet conduit 162 providing a second inlet to the booster pump 140. The two ports may be combined into a single port in this embodiment with the gas streams being joined before entering the booster pump. In this embodiment, the inlet conduit 162 is, when the booster pump 140 is mounted relative to the compound pump 100, substantially co-axial to the exhaust conduit 122 of the compound pump 100. This can enable the exhaust conduit 122 to be directly connected to the inlet conduit 162 of the booster pump 140 without the need for any intermediate arrangement of one or more conduits to convey fluid exhaust from the compound pump 100 to the booster pump 140. However, depending on the relative positions of the compound pump 100 and booster pump 140, it is envisaged that one or more conduits may be required in practice to convey fluid between the pumps 100, 140.

In use, fluid passing through inlet conduit 162 from the compound pump 100 passes through the pumping section 150 and exits the booster pump 140 via exhaust conduit 164. Fluid passing through the first inlet 160 from the high pressure chamber 11 also passes through the pumping section 150 and exits the booster pump 140 via exhaust conduit 164. From the exhaust conduit 164, fluid is conveyed by a conduit arrangement 166 to the inlet 168 of the backing pump 142.

Figure 4:
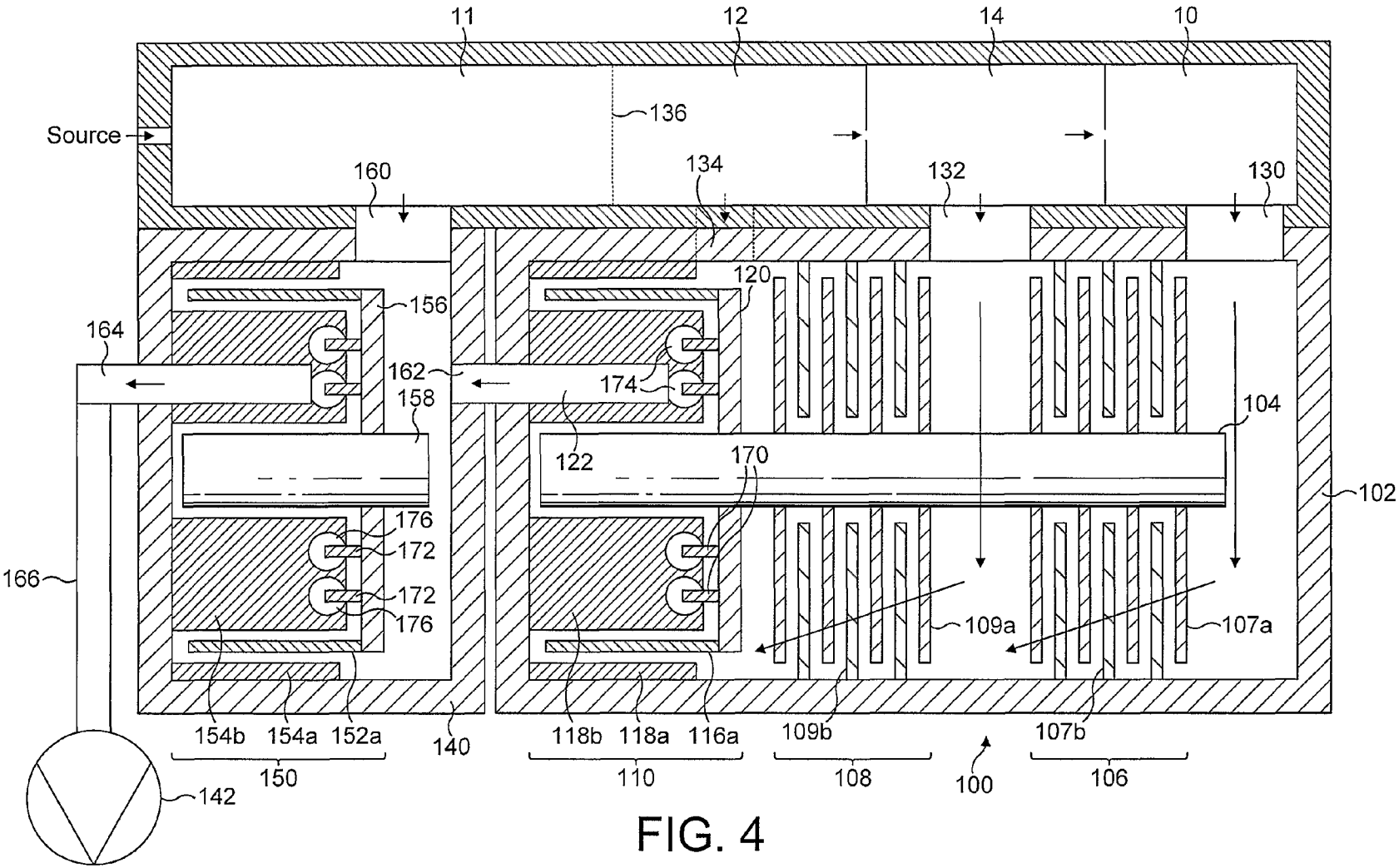
FIG. 4 is a simplified cross-section through a third embodiment of a pumping arrangement suitable for evacuating the differentially pumped mass spectrometer system of FIG. 1.

FIG. 4 illustrates a third embodiment of a pumping arrangement. This pumping arrangement is similar to that of the second embodiment, with the exception that each of the third pumping section 110 of the compound pump 100 and the pumping section 150 of the booster pump 140 comprises, in addition to a molecular drag pumping mechanism, a regenerative pumping mechanism.

Each regenerative pumping mechanism comprises a plurality of rotors in the form of at least one annular array of blades 170; 172 mounted on, or integral with, one side of the disc 120; 156 of the respective molecular drag mechanism. In this embodiment, each regenerative pumping mechanism comprises two concentric annular arrays of rotors 170; 172, although any number of annular arrays may be provided depending on pressure, flow rate and capacity requirements.

The innermost stator element 118*b*; 154*b* of each molecular drag pumping mechanism can also form the stator of the respective regenerative pumping mechanism, and has formed therein annular channels 174; 176 within which the rotors 170; 172 rotate. As is known, the channels 174; 176 have a cross sectional area greater than that of the individual blades 170; 172, except for a small part of the channel known as a "stripper" which has a reduced cross section providing a close clearance for the rotors. In use, pumped fluid pumped enters the outermost annular channel via an inlet positioned adjacent one end of the stripper and the fluid is urged by means of the rotors along the channel until it strikes the other end of the stripper. The fluid is then urged through a port into the innermost annular channel, where it is urged along the channel to the exhaust conduit 122; 164 from the pump, which is extended in comparison to the second embodiment to the innermost channel of the regenerative pumping mechanism.

In this example, in use, and similar to the system described with reference to FIG. 1, the high pressure chamber 11 is at a pressure around 1-10 mbar, the optional chamber 12 (where used) is at a pressure of around $10^{-1}$-1 mbar, the middle pressure chamber 14 is at a pressure of around $10^{-2}$-$10^{-3}$ mbar, and the low pressure chamber 10 is at a pressure of around $10^{-5}$-$10^{-6}$ mbar. However, due the compression of the gas passing through the pump by the regenerative pumping mechanism, the regenerative pumping mechanism can serve to deliver a reduced backing pressure to the molecular drag pumping stage mechanism. This can significantly reduce the power consumption of both the compound pump 100 and the booster pump 140, and improve performance of the pumping arrangement.

Furthermore, as indicated in FIG. 4, the rotors 170; 172 of the regenerative pumping mechanism are surrounded by the rotating cylinder 116*a*; 152*a* of the molecular drag pumping mechanism. Thus, a regenerative pumping mechanism can be conveniently included in the pumps 100, 140 with little, or no, increase in the overall length or size of the vacuum pump.

It should be noted that whilst in this embodiment both of the third pumping section 110 of the compound pump 100 and the pumping section 150 of the booster pump 140 include a regenerative pumping mechanism, of course, only one of these pumping sections may be provided with such a pumping mechanism. Furthermore, alternative pumping mechanisms may be provided instead of, or in addition to, the regenerative pumping mechanism. For example, one or both of the stages of the regenerative pumping mechanism may be replaced by a Gaede pumping stage, and/or additional pumping stages may be provided upstream from the Holweck mechanism. Examples of such additional pumping stages include externally threaded rotors and turbomolecular stages.

Figure 5:
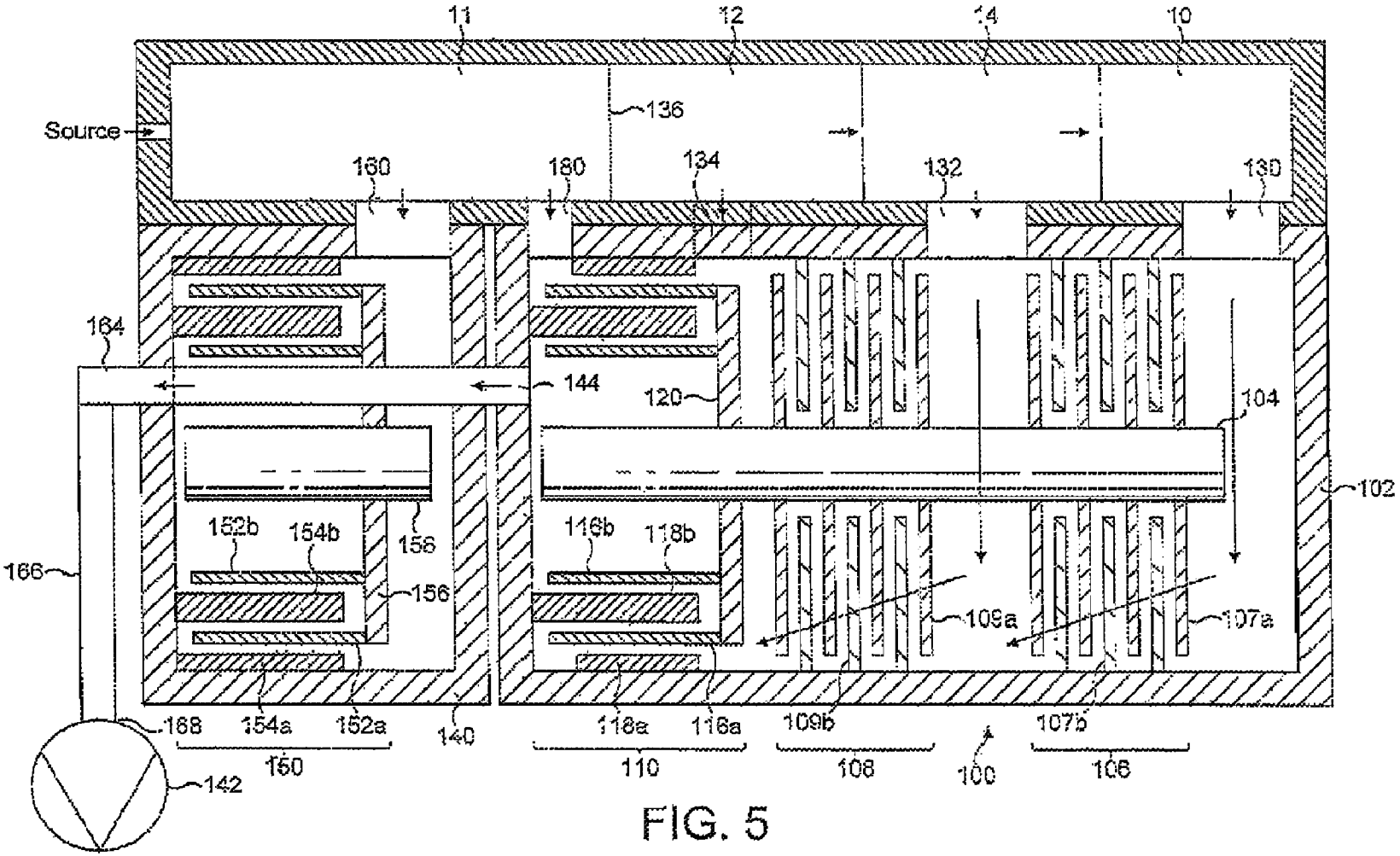
FIG. 5 is a simplified cross-section through a fourth embodiment of a pumping arrangement suitable for evacuating the differentially pumped mass spectrometer system of FIG. 1.
Figure 6:
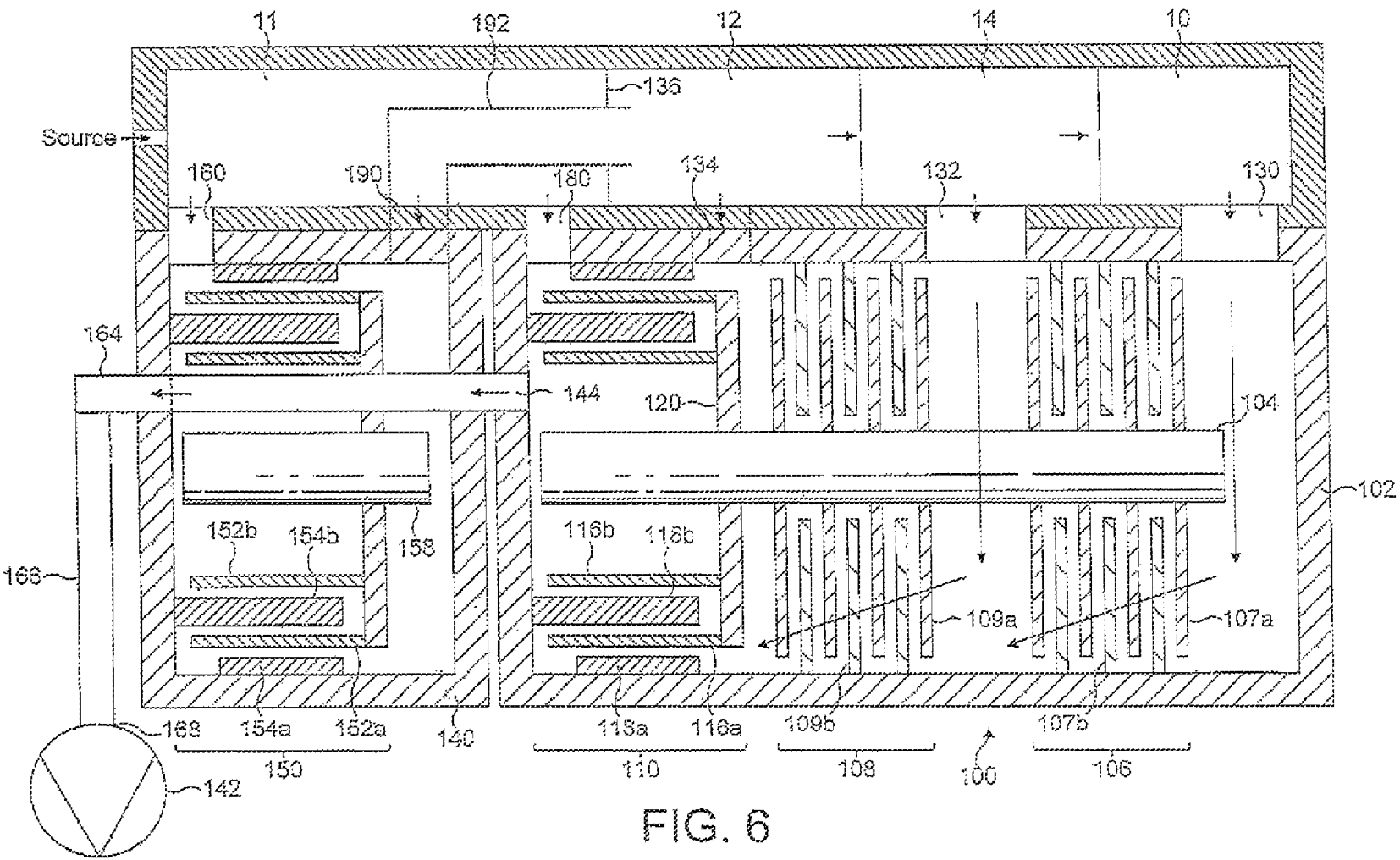
FIG. 6 is a simplified cross-section through a fifth embodiment of a pumping arrangement suitable for evacuating the differentially pumped mass spectrometer system of FIG. 1.
Figure 7:
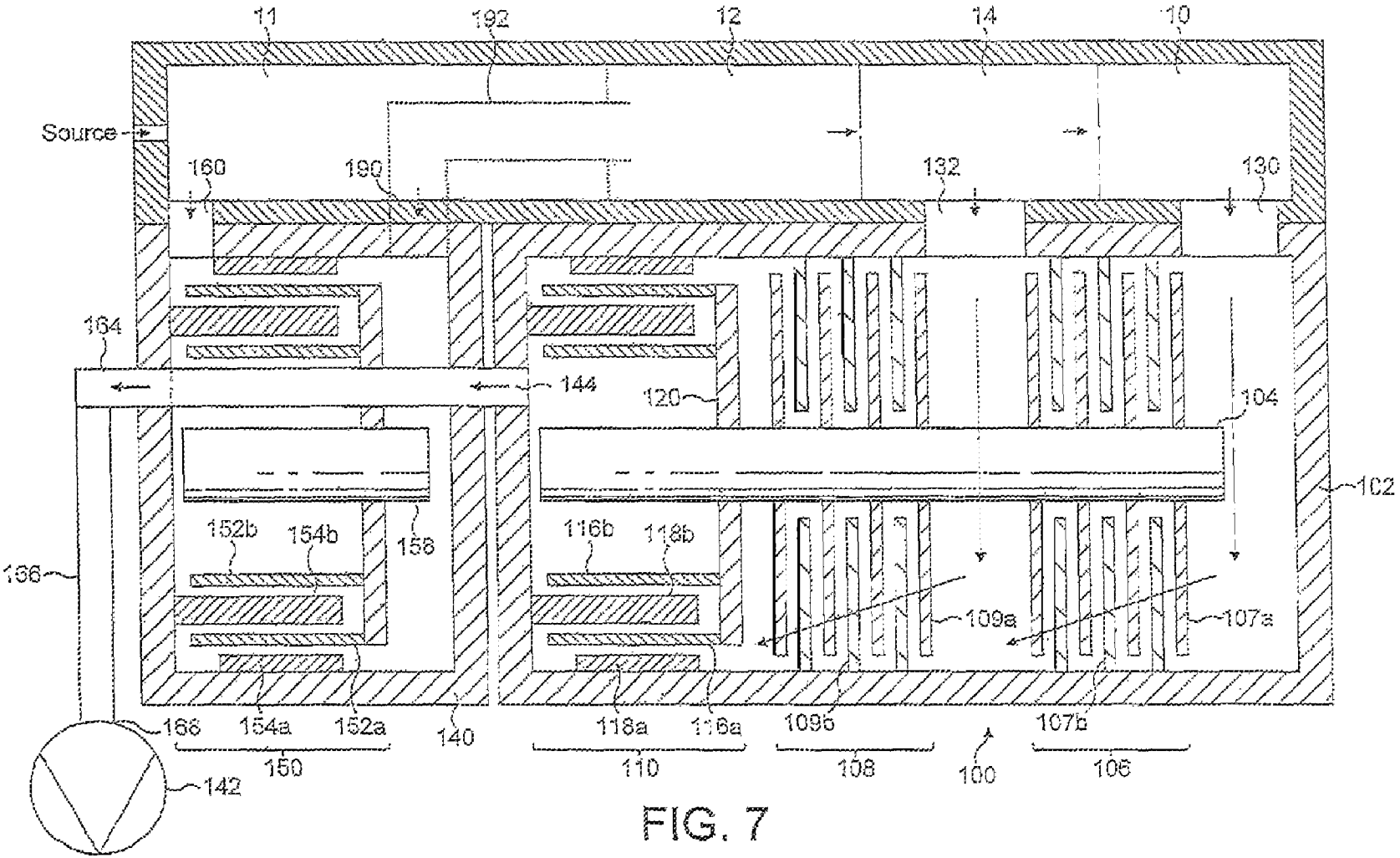
FIG. 7 is a simplified cross-section through a sixth embodiment of a pumping arrangement suitable for evacuating the differentially pumped mass spectrometer system of FIG. 1.

In addition to varying the pumping mechanisms provided in one or both of the compound pump 100 and the booster 140 to meet the required pumping performance and power consumption, the number and relative positions of the inlets to the compound pump 100 and booster pump 140 may be varied according to the number of chambers to be evacuated using the pumping arrangement and the performance requirement at each chamber. For instance, additional inlets may be provided in each pump, with the inlets being selectively opened as required for connection to an outlet from a particular chamber. Furthermore, parallel pumping of additional, or alternative, chambers through similar or dissimilar inlets can also be provided depending upon the gas load distribution and performance requirements of the chambers of the differentially pumped system. FIGS. 5 to 7 illustrate some embodiments of such pumping arrangements, based on the second embodiment illustrated in FIG. 3 (although of course similar embodiments may also be based on the third embodiment illustrated in FIG. 4). These embodiments illustrate how a chamber of the differentially pumped system can be evacuated, as required, by one of:

- a series arrangement of the compound pump, booster pump and backing pump;
- a series arrangement of the booster pump and backing pump;
- a series arrangement of the compound pump and backing pump;
- a series arrangement of the compound pump, booster pump and backing pump in parallel with a series arrangement of the booster pump and backing pump; and
- a series arrangement of the compound pump and backing pump in parallel with a series arrangement of the booster pump and backing pump;

so as to meet the performance requirements of the differentially pumped system.

With reference first to FIG. 5, in this third embodiment of a pumping arrangement, the compound pump 100 is arranged so as to be able to pump directly the highest pressure chamber, in addition to the low pressure chamber 10 and middle pressure chamber 14. As well as the inlets 130, 132 and optional inlet 134, the compound pump 100 contains an additional inlet 180 located upstream of or, as illustrated in FIG. 5, between the stages of the molecular drag pumping mechanism, such that all of the stages of the molecular drag pumping mechanism are in fluid communication with the inlets 130, 132, whilst, in the arrangement illustrated FIG. 5, only a portion (one or more) of the stages are in fluid communication with the additional inlet 180. Furthermore, in this third embodiment, the exhaust conduit 144 of the compound pump 100 is connected to one of the exhaust conduit 164 of the booster pump 140 or the conduit arrangement 166 so that fluid exhaust from the compound pump 100 is conveyed to the backing pump 142 rather than to the booster pump 140.

In use, inlet 130 is connected to an outlet from the low pressure chamber 10, and inlet 132 is connected to an outlet from the middle pressure chamber 14. Where the optional chamber 12 is present between the high pressure chamber 11 and the middle pressure chamber 14, as indicated by the dotted line 136, the optional inlet 134 is opened and connected to the chamber 12. The additional inlet 180 is connected to another outlet from the high pressure chamber 11.

As a result, fluid passing through the additional inlet 180 from the high pressure chamber 11 passes through two of the three, (although in practice the number may be different depending upon the performance requirements), stages of the third pumping section 110 of the compound pump 100, exits the compound pump 100 via the exhaust conduit 144 and enters the backing pump 142. In contrast, fluid passing through the first inlet 160 of the booster pump 140 from the high pressure chamber 11 passes through all of the stages of the pumping mechanism 150 of the booster pump 140 before exiting from the booster pump 140 via the exhaust conduit 164.

Thus, in the embodiment described above, parallel pumping of one of the chambers is provided by connecting dissimilar inlets of the two pumps, namely the additional inlet 180 of the compound pump 100 and the first inlet 160 of the booster pump 140, to the same chamber, in the case shown to the high pressure chamber 11. This arrangement optimises the pumping performance of the pumping arrangement both for the additional pumping requirements posed by the introduction of an additional gas load into the high pressure chamber 11 and for each of the other chambers of the differentially pumped mass spectrometer system. Providing such parallel pumping of a chamber provides a greater level of performance on the parallel pumped chamber than using a single pump inlet of the same capacity.

In the fourth embodiment of a pumping arrangement illustrated in FIG. 6, the compound pump 100 has the same arrangement of inlets and connections to the outlets from the chambers 10, 11, 12, 14 as the compound pump of the third embodiment. In this fourth embodiment, the arrangement of the inlets of the booster pump 140 is now such that the first inlet 160 is located at an equivalent position to the additional inlet 180 of the compound pump 100, that is, between stages of the multi-stage Holweck mechanism of the booster pump 140, and a second, optional inlet 190 is now located in an equivalent position to the optional inlet 134 of the compound pump 100, that is, upstream of all of the stages of the multi-stage Holweck mechanism of the booster pump 140. As indicated at 192 in FIG. 6, flow guides or conduits are provided for connecting the optional inlet 190 of the booster pump 140 to the optional chamber 12.

In use, the first inlet 160 of the booster pump 140 is connected to one outlet from the high pressure chamber 11 and the additional inlet 180 of the compound pump 100 is connected to another outlet from the highest pressure chamber 11. As a result, fluid passing through the additional inlet 180 from the high pressure chamber 11 passes through two of the three stages (in this example) of the third pumping section 110 of the compound pump 100, exits the compound pump 100 via the exhaust conduit 144. and is conveyed to the hacking pump 142. Fluid passing through the inlet 160 of the booster pump 140 similarly passes through two of the three stages of the pumping mechanism 150 of the booster pump 140 and exits the booster pump 140 via the exhaust conduit 164, and is conveyed to the backing pump 142.

In addition, where the chamber 12 is present between the high pressure chamber 11 and the middle pressure chamber 14, the optional inlet 190 of the booster pump 140 is connected to fourth chamber 12 via flow guides 192 and the optional inlet 134 of the compound pump 100 is connected to another outlet from the chamber 12. As a result, fluid passing through the optional inlet 134 from this chamber 12 passes through all of the stages of the third pumping section 110 of the compound pump 100, exits the compound pump 100 via the exhaust conduit 144, and is conveyed to the backing pump 142. Fluid passing through the optional inlet 190 of the booster pump 140 similarly passes through all of the stages of the pumping mechanism 150 of the booster pump 140 and exits the booster pump 140 via the exhaust conduit 164, and is conveyed to the backing pump 142.

This arrangement can thus provide "true" parallel pumping of the high pressure chamber 11, and, where provided, the optional chamber 12, in that the pumping performance at the inlet 160 of the booster pump 140 is that same as that at the inlet 190 of the compound pump.

In the fifth embodiment of a pumping arrangement illustrated in FIG. 7, the booster pump 140 has a similar arrangement of inlets as in the fourth embodiment illustrated in FIG. 6. However, in comparison to the compound pump of the fourth embodiment, in this fifth embodiment the compound pump 100 comprises only the first inlet 130 and the second inlet 132. As a result, the high pressure chamber 11 and, where provided, the optional chamber 12, are evacuated by the series connection of the booster pump 140 and the backing pump 142, whilst the low pressure chamber 10 and the middle pressure chamber 14 are evacuated by a series connection of the compound pump 100 and the backing pump 142.

While the foregoing description and drawings represent the preferred embodiments of the present invention, it will be apparent to those skilled in the art that various changes and modifications may be made therein without departing from the true spirit and scope of the present invention.

I claim

1. A pumping arrangement for differentially pumping a plurality of chambers comprising:

a compound pump having a first inlet for receiving fluid from a first chamber; a second inlet fir receiving fluid from a second chamber; a third inlet for receiving fluid from a third chamber, a fourth inlet for receiving fluid from a fourth chamber; a first pumping section; a second pumping section downstream from the first pumping section; a third pumping section downstream from the second pumping section and wherein the first, second, and third pumping sections being arranged such that fluid entering the compound pump from the first inlet passes through the first second, and third pumping sections, fluid entering the compound pump from the second inlet passes through, of said sections, only the second and third pumping sections, and fluid entering the compound pump from the third and fourth inlets passes through, of said sections, only the third pumping section;

a booster pump having a first inlet for receiving fluid from the forth chamber in parallel with the fourth inlet of the compound pump;

a backing pump having an inlet for receiving fluid exhaust from the booster pump; and means for conveying fluid from the pumping sections of the compound pump to the backing pump.

2. The pumping arrangement according to claim 1 wherein each of the first, second and third pumping sections of the compound pump comprises a dry pumping stage.

3. The pumping arrangement according to claim 1 wherein at least one of the first and second pumping sections comprises at least one turbo-molecular stage.

4. The pumping arrangement according to claim 1 wherein both of the first and second pumping sections comprise at least one turbo-molecular stage.

5. The pumping arrangement according to claim 1 wherein the third pumping section comprises at least one molecular drag stage.

6. The pumping arrangement according to claim 5 wherein the third pumping section comprises a multi-stage Hoiweck mechanism with a plurality of channels arranged as a plurality of helixes.

7. The pumping arrangement according to claim 1 wherein the third pumping section is positioned relative to the second and fourth inlets such that fluid passing therethrough from the fourth inlet follows a different path from fluid passing therethrough from the second inlet.

8. The pumping arrangement according to claim 1 wherein the booster pump comprises at least one molecular drag stage.

9. The pumping arrangement according to claim 8 wherein the booster pump comprises a multi-stage Holweck mechanism with a plurality of channels arranged as a plurality of helixes.

10. The pumping arrangement according to claim 1 wherein the booster pump is frequency-independent.

11. The pumping arrangement according to claim 10 wherein the booster pump is a scroll pump.

12. The pumping arrangement according to claim 1 wherein the booster pump comprises a plurality of pumping stages.

13. The pumping arrangement according to claim 12 wherein each pumping stage of the booster pump comprises a dry pumping stage.

14. The pumping arrangement according to claim 12 wherein the booster pump comprises a molecular drag pumping mechanism.

15. The pumping arrangement according to claim 14 wherein the molecular drag pumping mechanism comprises a multi-stage Holweck mechanism with a plurality of channels arranged as a plurality of helixes.

16. The pumping arrangement according to claim 1 wherein the booster pump comprises a second inlet for receiving fluid from the third chamber.

17. The pumping arrangement according to claim 16 wherein the booster pump comprises a plurality of pumping stages arranged relative to the first, and second inlets of the booster pump such that fluid entering the booster pump through one of the first, and second inlets of the booster pump passes through a different number of pumping stages than fluid entering the booster pump through the other one of the first, and second inlets of the booster pump.

18. The pumping arrangement according to claim 16 wherein the means for conveying fluid comprises conduit means arranged to connect the exhaust from the compound pump and the exhaust of the booster pump to the inlet of the backing pump.

19. The pumping arrangement according to claim 2 wherein the booster pump comprises a plurality of pumping stages and wherein the first, second and third pumping sections of the compound pump are co-axial with the pumping stages of the booster pump.

20. The pumping arrangement according to claim 1 wherein the booster pump is mounted on the compound pump.

21. The pumping arrangement according to claim 1 wherein the booster pump is mounted on the backing pump.

22. The system according to claim 1 wherein the compound pump is mounted on at least one of the first and second chambers.

23. The system according to claim 1 wherein the first, second, third and fourth chambers form part of a mass spectrometer system.

24. The pumping arrangement of claim 1 wherein the booster pump is an inverter driven pump.

* * * * *